US006131225A

United States Patent [19]

Puglisi

[11] Patent Number: 6,131,225

[45] Date of Patent: Oct. 17, 2000

[54] DOCKING ASSEMBLY FOR A SHUTTLE

[75] Inventor: Thomas C. Puglisi, Kensington, Conn.

[73] Assignee: Otis Elevator Company, Farmington, Conn.

[21] Appl. No.: 08/839,695

[22] Filed: Apr. 15, 1997

[51] Int. Cl.[7] ..... E01K 7/00; E01K 11/02; E01K 11/04

[52] U.S. Cl. ..... 14/71.1; 14/69.5; 14/78

[58] Field of Search ..... 14/72.5, 71.5, 14/71.1, 73; 104/20, 28, 30

[56] References Cited

U.S. PATENT DOCUMENTS

| | | | |
|---|---|---|---|
| 3,964,118 | 6/1976 | Meyers et al. | 14/72.5 |
| 4,347,638 | 9/1982 | Weaver | 14/71.1 |
| 4,787,111 | 11/1988 | Pacek et al. | 14/71.1 |
| 4,862,547 | 9/1989 | Alten | 14/71.1 |
| 5,442,825 | 8/1995 | Hahn et al. | 14/71.1 |
| 5,761,757 | 6/1998 | Mitchell et al. | 14/71.5 |
| 5,813,071 | 9/1998 | Breslin et al. | 14/71.1 |
| 5,815,871 | 10/1998 | Borchardt | 14/71.1 |
| 5,832,555 | 2/1995 | Saucier et al. | 14/71.1 |
| 5,881,414 | 3/1999 | Alexander | 14/71.1 |

FOREIGN PATENT DOCUMENTS

| | | | |
|---|---|---|---|
| 2800128 | 7/1979 | Germany | 404/71.1 |

*Primary Examiner*—Eileen D. Lillis
*Assistant Examiner*—Raymond W. Addie

[57] ABSTRACT

A docking assembly for the platform of a shuttle system includes a movable plate extending outward from the platform. The plate is engageable with an end wall of the shuttle such that the plate extends from the platform to the shuttle. As a result of the ability of the plate to move, the platform accommodates the variation in stopping positions of the shuttle and permits end docking of the shuttle without the need to precisely position the shuttle. In a particular embodiment, the docking assembly includes a guard rail extending outward from the platform and disposed in a pivoting relationship such that, upon sufficient motion of the shuttle toward the platform, the guard rail pivots away from the shuttle.

5 Claims, 6 Drawing Sheets

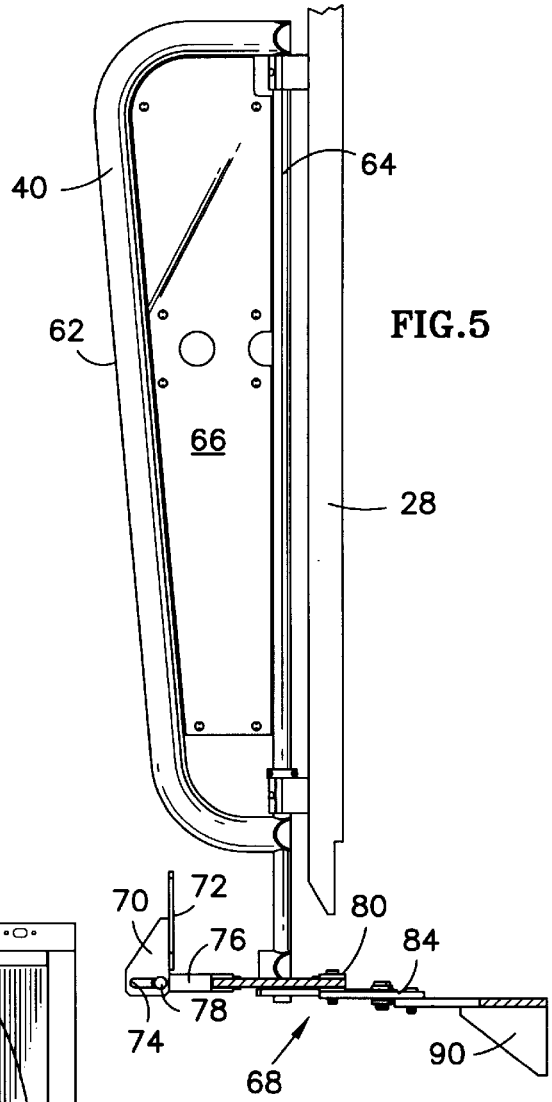
FIG.5
FIG.4
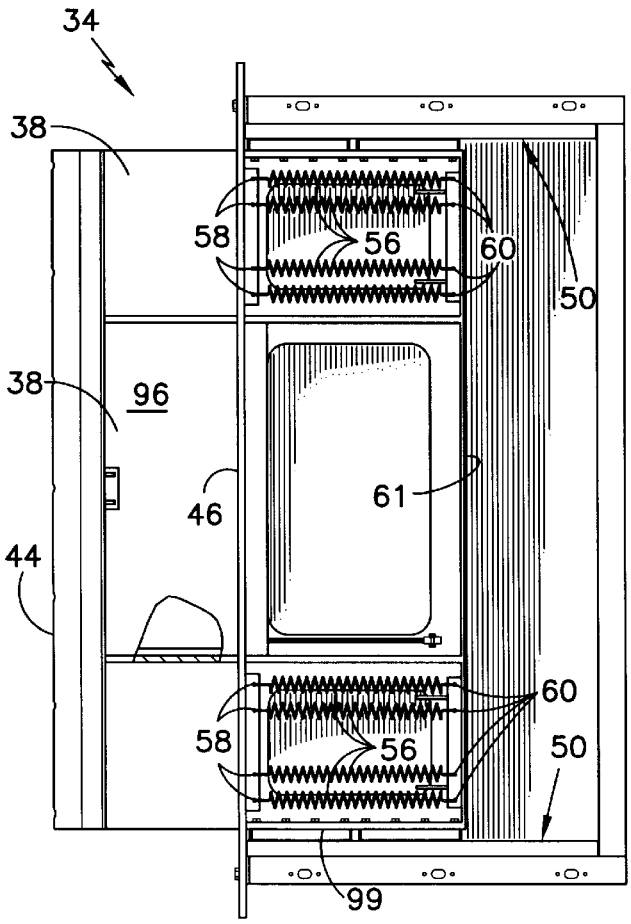

θ
60.0°
φ
76.5°

θ
30.0°
φ
90°
90
92
84
98
82
98
84
92
94
86
86
94
40
64
80
76
64
40
70

DOCKING ASSEMBLY FOR A SHUTTLE

TECHNICAL FIELD

The present invention relates to passenger shuttles, and particularly to shuttles that use end docking to transfer passengers between the shuttle and the station.

BACKGROUND OF THE INVENTION

Shuttle systems are an efficient and cost effective way to move people back and forth between two or more moderately distant locations or stations. A typical shuttle system includes one or more shuttles that repeatedly travel between the two locations. Each station includes a platform that defines a transfer point for passengers entering and exiting the shuttles.

The transfer of passengers between the shuttle and the platform is commonly performed through doors located in the side walls of the shuttle, i.e., side docking. This location, while it may permit the most efficient transfer of passengers, requires the fabrication of a large platform. The large platform is necessary to accommodate the various locations of the side doors and to accommodate the variability in the stopping position of the shuttle. The construction costs associated with the large platform may not be cost effective. In addition, in many applications there may be insufficient space available to accommodate side docking of the shuttle.

In shuttle applications that do not permit side docking, either because of cost or space, end docking is used. In end docking, the entrance to the shuttle is located in the end wall of the shuttle. The shuttle docks by moving up to the platform until the end wall of the shuttle and the platform are close enough to permit passengers to transfer. In this configuration, the platform may be smaller and, as a result, so may be the construction costs and the space requirements. A drawback to this type of docking, however, is that the stopping position of the shuttle must be precise in order to prevent excessive gaps from occurring between the shuttle and the platform or damaging contact between the shuttle and the platform. The requirement to precisely position the shuttle for the transfer of passengers degrades the operational efficiency of the shuttle system.

The above art notwithstanding, scientists and engineers under the direction of Applicant's Assignee are working to develop efficient and cost effective docking mechanisms for shuttle systems.

DISCLOSURE OF THE INVENTION

According to the present invention, a docking assembly for the platform of a shuttle system includes a movable plate extending outward from the platform. The plate is engageable with an end wall of the shuttle such that the plate extends from the platform to the shuttle. As a result of the ability of the plate to move, the platform accommodates the variation in stopping positions of the shuttle and permits end docking of the shuttle without the need to precisely position the shuttle.

In a particular embodiment of the present invention, the docking assembly includes means to bias the plate into a resting position and to resist the motion of the plate away from the resting position caused by engagement of the plate with the end wall. As a result of the biasing means, the engagement between the plate and the end wall is maintained to avoid gaps between the platform and the shuttle.

According further to the present invention, a docking assembly includes a guard rail extending outward from the platform and disposed in a pivoting relationship such that, upon excessive motion of the shuttle toward the platform, the guard rail pivots away from the shuttle. The safety of the passengers transferring between the platform and shuttle is enhanced as a result of the guard rails. The guard rails block excessive lateral motion of the passengers transferring between the shuttle and the platform.

In a particular embodiment, the guard rail is connected to the plate by a linkage system and a connector. The linkage system is engaged with the guard rail to pivot the guard rail. The connector is engaged with both the plate and the linkage system in a manner such that the plate is permitted to move a predetermined distance away from the resting position before the linkage system begins to move the guard rail. As a result of this embodiment, the guard rails extend toward the shuttle during normal stopping, while damaging contact between the shuttle and the guard rail is prevented from occurring if an overrun of the shuttle occurs.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 4 is a bottom view of the movable plate.

FIG. 5 is a side view of a guard rail.

BEST MODE FOR CARRYING OUT THE INVENTION

Figure 1:
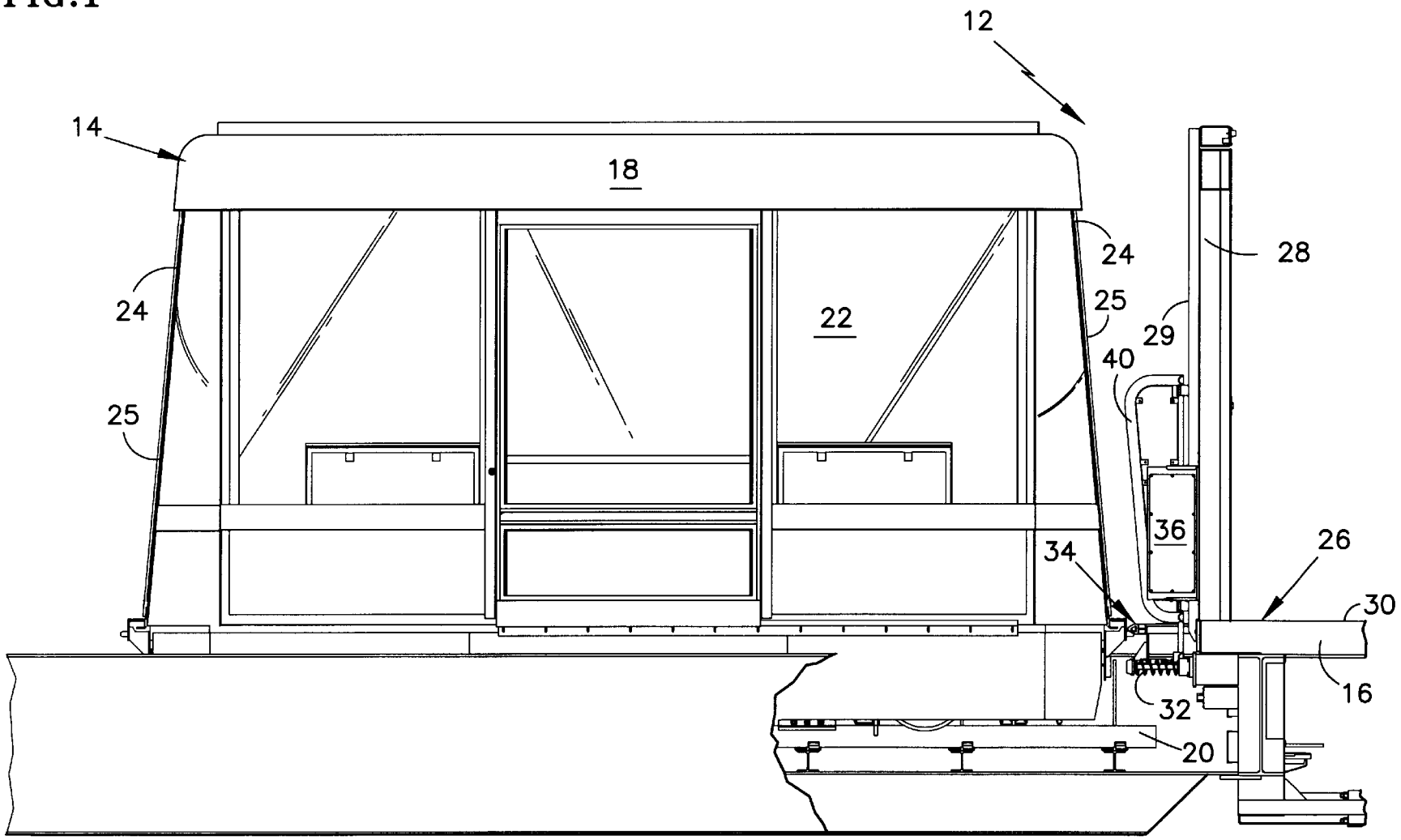
FIG. 1 is a side view of a shuttle and an end docking platform.
Figure 2:
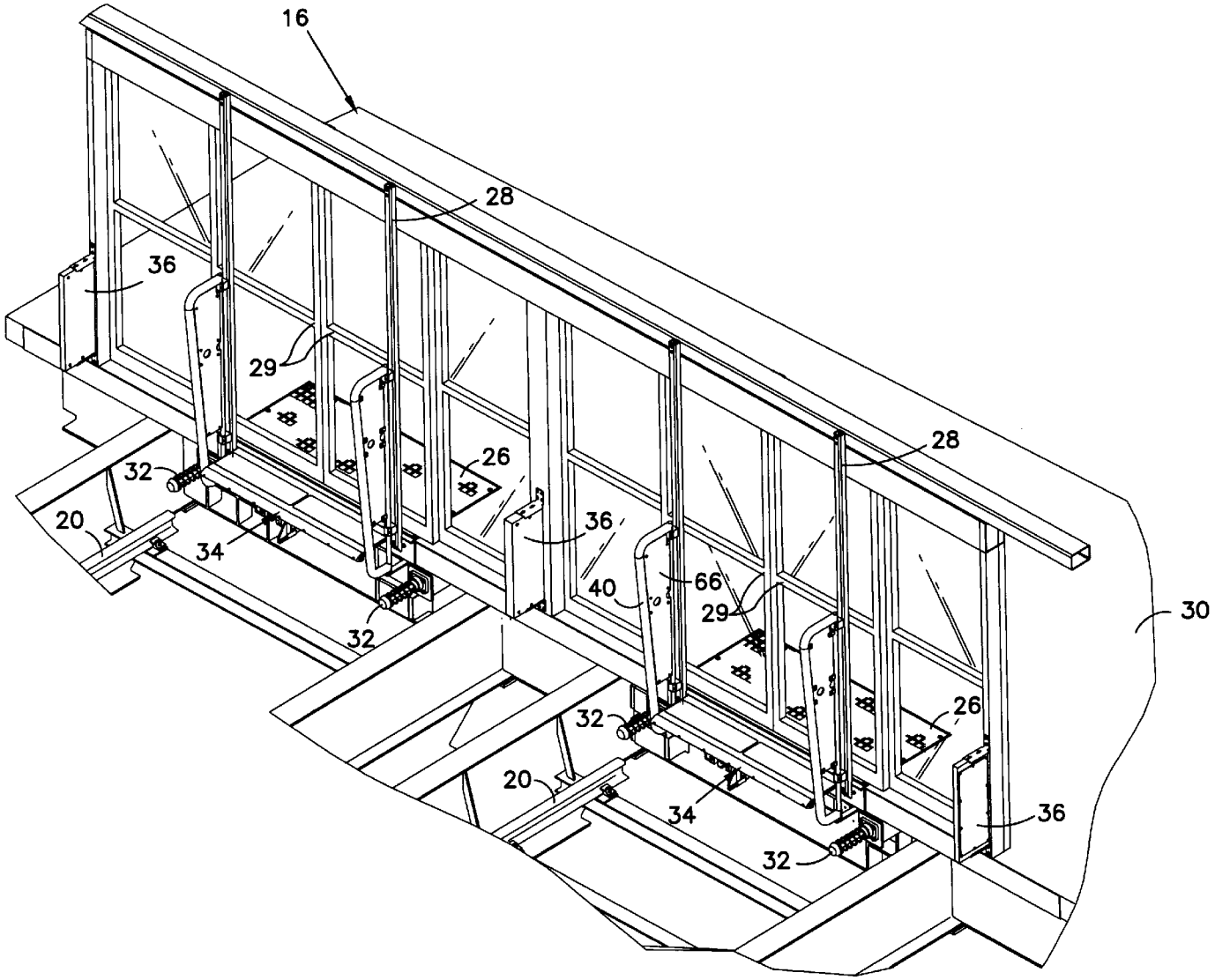
FIG. 2 is a perspective view of the end docking platform, with the shuttle removed for clarity.

Illustrated in FIGS. 1 and 2 is a shuttle system 12 that uses end docking to transfer passengers between a shuttle 14 and a platform 16. The shuttle 14, shown only in FIG. 1, is a wheeled car 18 that travels on tracks 20 that extend from the platform 16 to another remotely located platform (not shown). The car 18 includes a pair of side walls 22 and a pair of end walls 24. Each of the end walls 24 includes a door 25 that opens to permit the exit and entrance of passengers.

The platform 16 defines the transfer area for a particular station along the shuttle system route and, as shown in FIG. 2, includes two landings 26, one for each set of tracks 20. The platform 16 includes a door frame 28 including a pair of doors 29, a floor 30, and a pair of buffers 32 for each set of tracks 20. Each landing 26 includes a docking assembly 34 and a photoelectric passenger sensing device 36.

The docking assembly 34 is shown in more detail in FIGS. 3–6. The docking assembly 34 includes a movable plate 38 and a pair of pivoting guard rails 40 located on opposite sides of the movable plate 38.

Figure 3A:
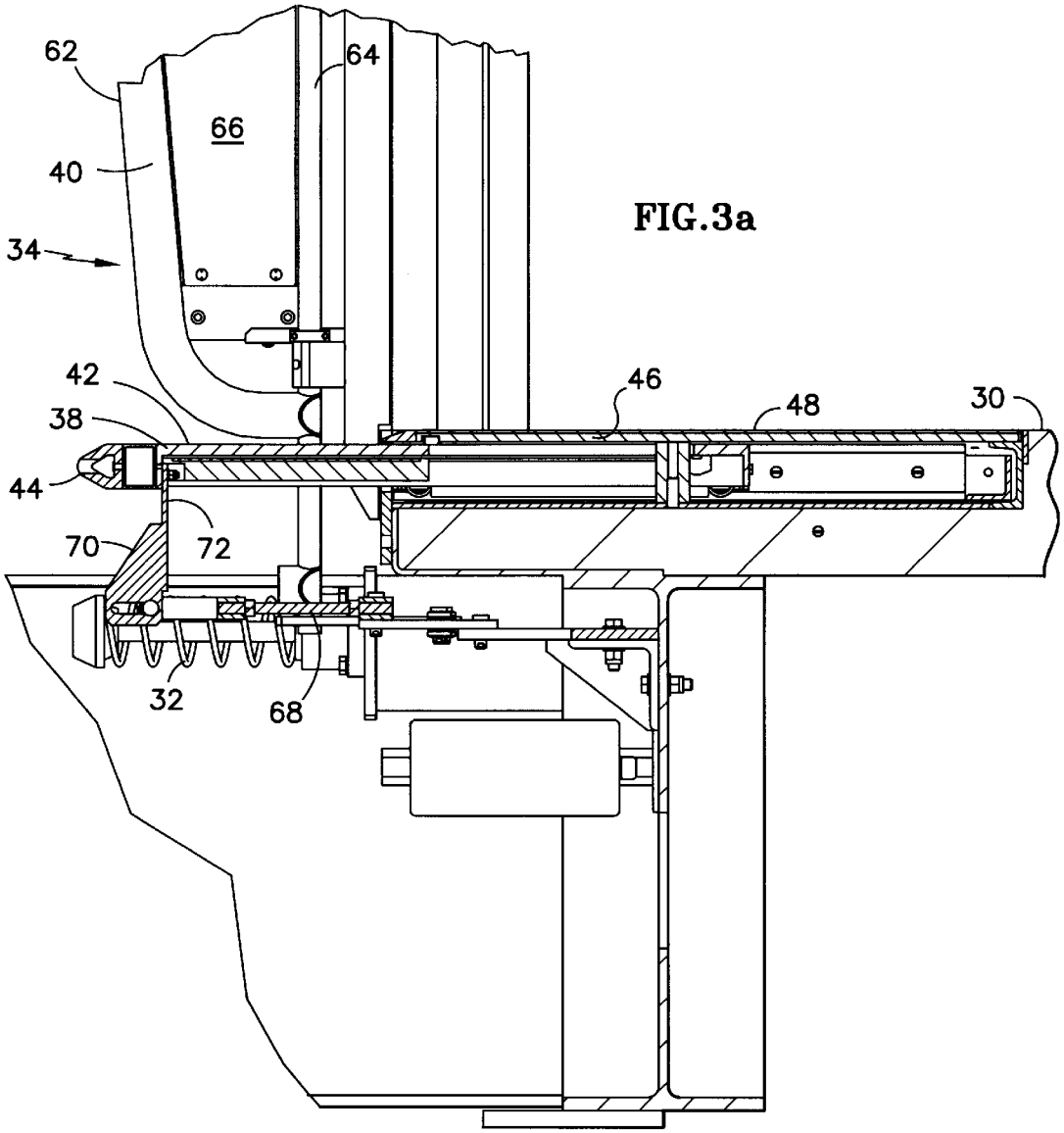
FIGS. 3*a* and 3*b* are a side view and end view, respectively, partially cut away to show a movable plate that extends outward from the platform.
Figure 3B:
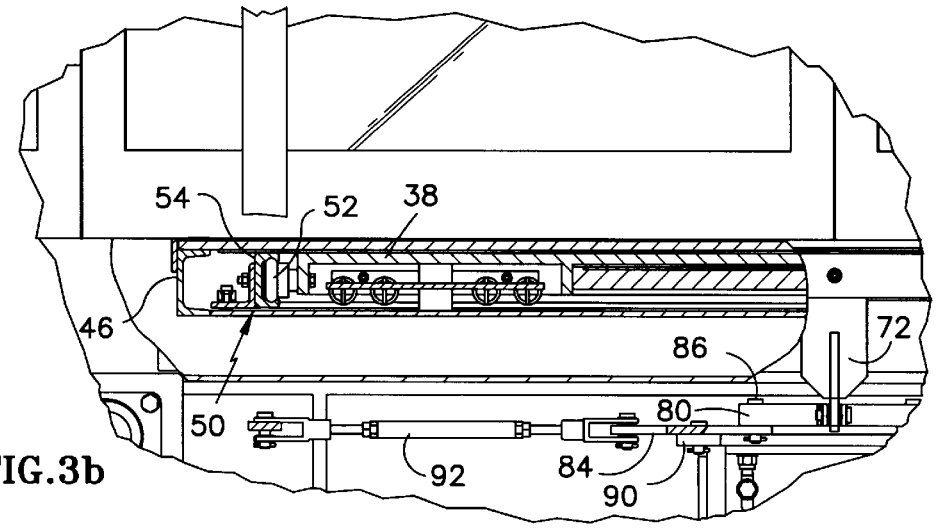

The movable plate 38, shown in FIGS. 3*a*, 3*b* and 4, includes a top surface 42 that provides traction for passengers and an outer edge 44 formed from a hollow, preformed strip of an elastomeric material that defines a contact surface. The movable plate 38 is in rolling engagement with a support frame 46 that is recessed into the floor 30 of the platform 16. The top surface 48 of the support frame 46 is flush with the floor 30 to form a smooth transition between the support frame 46 and the floor 30 of the platform 16, while the top surface 42 of the plate 38 is slightly below the top surface 48 of the support frame 46.

The rolling support for the plate 38 is provided by a roller and track assembly 50 disposed on both sides of the plate 38, as shown in FIG. 3*b*. The plate 38 is connected to a plurality of rollers 52 that are guided by a C-shaped channel 54 that is fixed to the support frame 46, as shown in FIG. 3*b*. An example of such a roller and track assembly 50 is commercially available from Pacific Bearing Company, located in Rockford, Ill., and sold under the name of "Rollon Slider". Although shown and described as having a roller type bearing, it should be apparent to one skilled in the art that other types of bearings may be equally applicable, such as sliding bearings.

As shown in FIG. 4, the docking assembly 34 includes a plurality of extension springs 56 that have one end 58 fixed to the support frame 46 and the opposite end 60 fixed to the inner end 61 of the plate 38. As installed, the springs 56 are extended from their resting position such that they define a biasing means on the plate 38 to urge the plate 38 in the outward direction and away from the landing 26. The plate 38 is held against the bias of the springs 56 by the side ribs 99 of the plate 38, such that the equilibrium or resting position for the plate 38 is in the extended position. As an alternative, other types of springs may be used to provide the biasing means, such as compressions springs.

During operation, the shuttle 14 enters the station and travels forward until the end wall 24 of the shuttle 14 contacts the outer edge 44 of the plate 38. As the shuttle 14 continues to move toward the landing 26, the plate 38 is moved into the support frame 46. The springs 56 resist this motion and thereby maintain contact between the plate 38 and the end wall 24 of the shuttle 14 until the shuttle 14 comes to a stop. If the overtravel of the shuttle 14 is excessive, the shuttle 14 will engage the buffers 32 located below the plate 38 to prevent damaging contact between the shuttle 14 and the landing 26. Once the shuttle 14 is stopped, the doors 25,29 open and passengers may transfer to and from the shuttle 14. The traction surface 42 of the plate 38 defines a walking surface for the transferring passengers. Upon completion of the passenger transfer, the doors 25,29 close and the shuttle 14 is moved away from the landing 26. The springs 56 urge the plate 38 outward from the platform 16 and into its resting position until a shuttle returns to the landing 26.

Each of the pair of guard rails 40, as shown in FIGS. 3*a*, 5 and 6, includes a tubular railing 62 extending about the outer edge of the guard rail 40, a shaft 64 attached to the landing 26 in a manner permitting rotation of the shaft 64, a translucent panel 66 extending between the railing 62 and the shaft 64, a linkage assembly 68 engaged with the shaft 64, and a connector 70 extending between the plate 38 and the linkage assembly 68. The railing 62 and panel 66 are attached to the shaft 64 and pivot about the shaft 64 when the shaft 64 rotates. The shape of the railing 62 is complementary to the shape of the end wall 24 of the shuttle 14 (see FIG. 1). The panel 66 is translucent to permit the photoelectric passenger sensing device 36 to pass a beam of light through the panels 66 and detect the presence of passengers between the shuttle 14 and the landing 26.

The linkage assembly 68 is disposed below the plate 38 and includes a first link 76 having a pin 78, a push rod 80 having a pair of slots 82, a pair of triangularly shaped pivot plates 84 having a pin 86 on one corner, a bracket 90, a pair of turn buckles 92, and a pair of second links 94. The connector 72 is fixed to the underside 96 of the movable plate 38 and includes a slot 74. The slot 74 of the connector 72 is slidingly engaged with the pin 78 on one end of the first link 76. The opposite end of the first link 76 is fixed to the push rod 80. Each of the slots 82 in the push rod 80 is slidingly engaged with one of the pins 86 on one of the pivot plates 84. Each pivot plate 84 is connected to the bracket 90 in a manner permitting each pivot plate 84 to pivot about a point 98 located at a second corner of the pivot plate 84. Each turn buckle 92 has one end pinned to the third corner of one of the pivot plates 84 such that it may rotate about the pinned connection and the opposite end pinned in a similar fashion to one end of one of the second links 94. The opposite end of each of the second links 94 is fixed to one of the shafts 64.

Figure 6B:
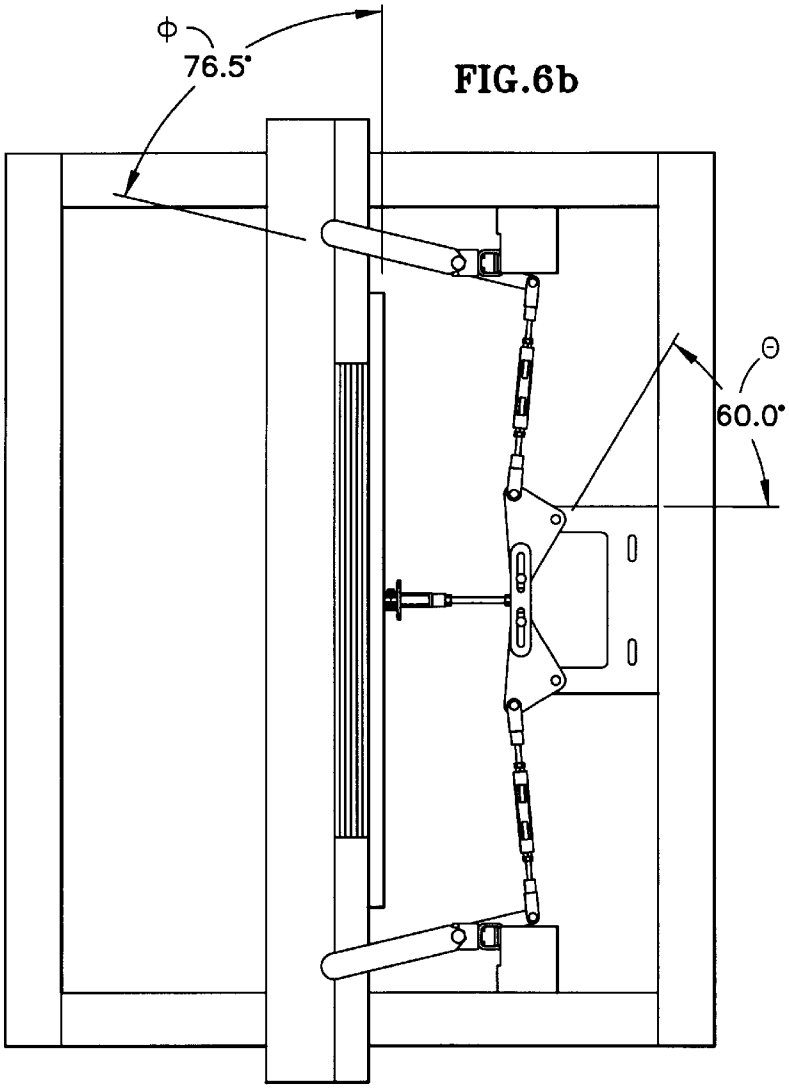
FIGS. 6 *a–d* are top views of the guard rails and linkage system, with the guard rails in various pivoted positions.
Figure 6A:
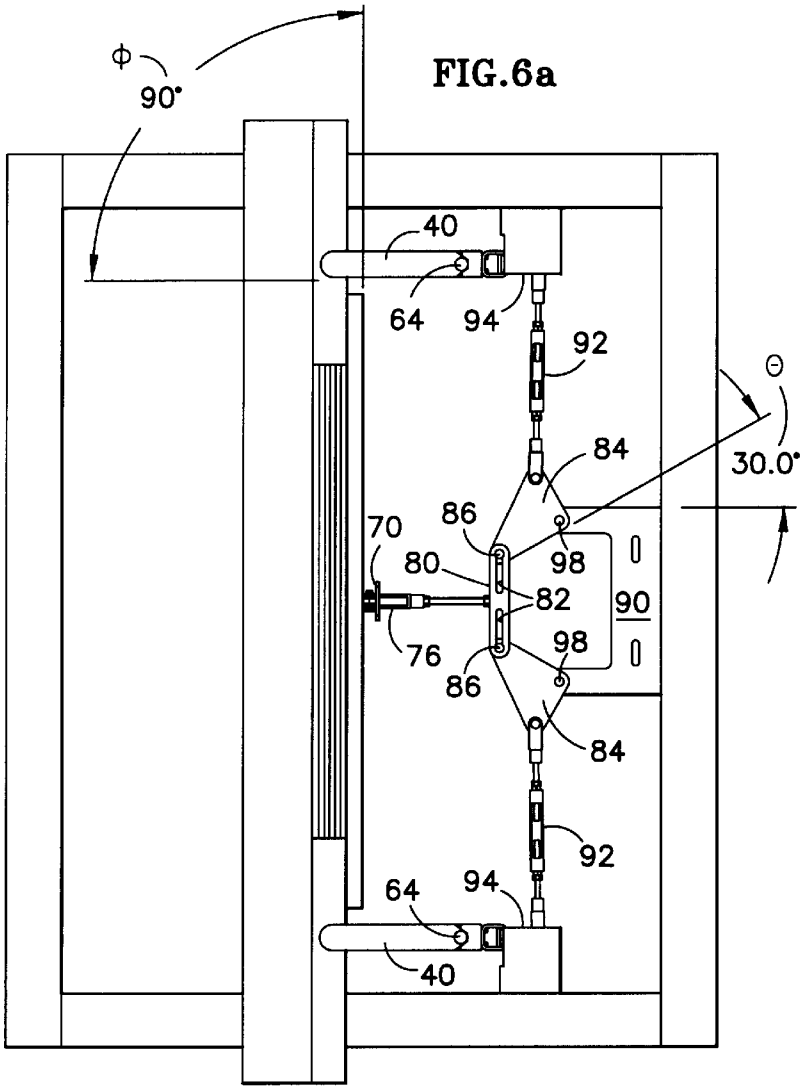
Figure 6D:
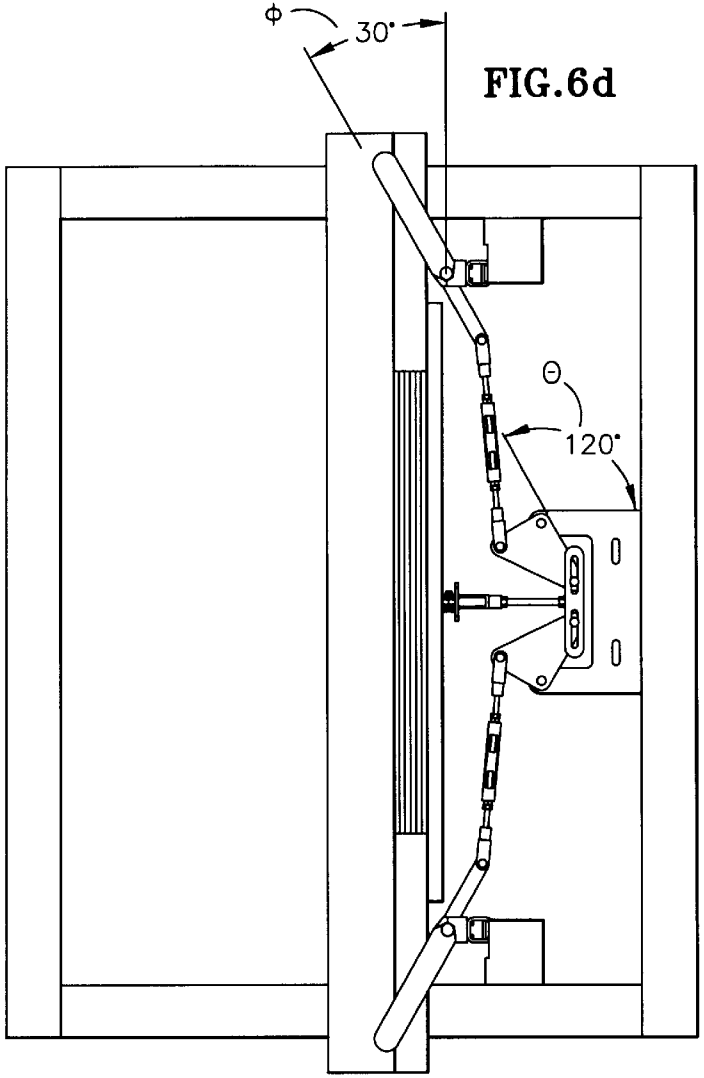
Figure 6C:
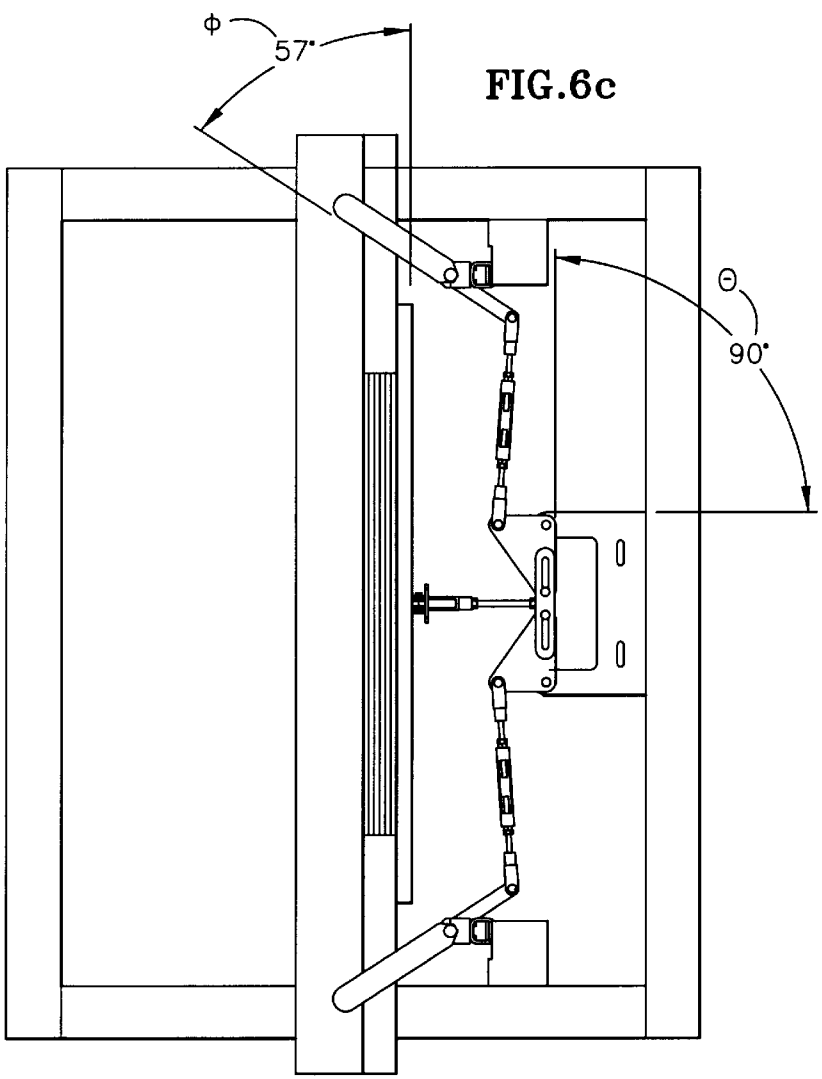

During operation, engagement between the shuttle 14 and the movable plate 38 causes the plate 38 to move into the support frame 46 as described previously. As the plate 38 moves, the connector 72 moves with it. As a result of the slotted connection between the connector 72 and first link 76, the initial movement of the plate 38 does not move the first link 76. The plate 38 is permitted a predetermined amount of movement (equivalent to the length of the slot) before the linkage assembly 68 is engaged. As shown in FIG. 6*a* in its initial position, one edge of the pivot plate 84 forms an angle $\theta$ of 30 degrees with the bracket 90. If the movement of the plate 38 exceeds the predetermined distance, then further movement of the plate 38 will cause the push rod 80 to pivot both pivot plates 84 as shown in FIGS. 6*b*–*d* and the plate will rotate through increasing angles of $\theta$. The pivot plates 84 rotate to pull the turn buckles 92 and second links 94. The movement of the second links 94 causes the shafts 64 to rotate and this rotation pivots both of the railings 62 and panels 66 in a coordinated manner. As shown in FIG. 6*a*, the guard rail 40 extends outward at an angle $\phi$ of 90 degrees from the landing 26 in its resting position. As the pivot plate 84 is rotated, the guard rails 40 pivot back toward the landing, and away from the approaching shuttle, such that the angle $\phi$ is reduced, as shown in FIGS. 6*b*–6*d*. The greater the overtravel of the shuttle 14, the more the guard rails 40 are pivoted. As a result, damaging contact between the shuttle 14 and the guard rails 40 is avoided.

Although the invention has been shown and described with respect to exemplary embodiments thereof, it should be understood by those skilled in the art that various changes, omissions, and additions may be made thereto, without departing from the spirit and scope of the invention.

What is claimed is:

1. A docking assembly for a platform of a passenger shuttle system, the passenger shuttle system including a shuttle having an end wall, the docking assembly including a movable plate disposed on the platform, the movable plate including a tread surface for passengers transferring between the shuttle and the platform, the plate being supported by a bearing for movement relative to the platform and having a resting position in which it extends outward from the platform, the plate including a contact surface that engages the end wall upon sufficient motion of the shuttle, and wherein the engagement with the end wall positions the plate such that it extends from the platform to the shuttle, further including a guard rail disposed on the platform in a pivoting relationship, the guard rail extending outward from the platform such that it blocks excessive lateral motion of the passengers transferring between the shuttle and the platform, and wherein the guard rail is connected by a linkage means to the plate such that upon sufficient motion of the plate away from its resting position the guard rail pivots away from the shuttle.

2. The docking assembly according to claim 1, wherein the linkage means includes a linkage assembly and a connector, the linkage assembly engaged with the guard rail to pivot the guard rail, the connector engaged with the plate and the linkage assembly in a manner such that the plate is permitted to move a predetermined distance away from the resting position before the linkage assembly begins to move the guard rail.

3. A guard rail for a platform of a passenger shuttle system, the passenger shuttle system including a shuttle having an end wall, the platform including a contact surface that engages the end wall upon sufficient motion of the shuttle, the guard rail disposed on the platform in a pivoting relationship, the guard rail extending outward from the platform such that it blocks excessive lateral motion of the passengers transferring between the shuttle and the platform, and wherein the guard rail is connected to the contact surface by a linkage means such that, upon sufficient motion of the end wall toward the platform, the guard rail pivots away from the shuttle.

4. The guard rail according to claim 3, wherein the guard is formed from two panels that extend outward from opposite sides of the doorway of the platform, wherein each panel is pivotally connected to the platform and connected to each other by a linkage assembly such that the pivotal motion of the panels is coordinated.

5. The guard rail according to claim 3, wherein the guard rail includes an outer edge that faces the end wall of the shuttle, and wherein the outer edge is contoured to the shape of the end wall.

* * * * *